US010468745B2

(12) United States Patent
Jeon et al.

(10) Patent No.: US 10,468,745 B2
(45) Date of Patent: Nov. 5, 2019

(54) SECURITY PAPER BASED ON RF TAG USING DIPOLE ARRAY STRUCTURE AND METHOD FOR MANUFACTURING THE SECURITY PAPER

(71) Applicant: ELECTRONICS AND TELECOMMUNICATIONS RESEARCH INSTITUTE, Daejeon (KR)

(72) Inventors: Dong-Ho Jeon, Daejeon (KR); Min-Sik Kim, Daejeon (KR); Seung-Jin Ryu, Daejeon (KR); Dae-Heon Lee, Daejeon (KR); Han-Jun Yoon, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 353 days.

(21) Appl. No.: 15/358,274

(22) Filed: Nov. 22, 2016

(65) Prior Publication Data

US 2018/0090812 A1 Mar. 29, 2018

(30) Foreign Application Priority Data

Sep. 28, 2016 (KR) ..... 10-2016-0124477

(51) Int. Cl.

| | |
|---|---|
| ***H01Q 1/38*** | (2006.01) |
| ***H01Q 1/22*** | (2006.01) |
| ***H01Q 9/06*** | (2006.01) |
| ***H01Q 21/06*** | (2006.01) |

(52) U.S. Cl.

CPC ..... *H01Q 1/2225* (2013.01); *H01Q 1/38* (2013.01); *H01Q 9/065* (2013.01); *H01Q 21/062* (2013.01)

(58) Field of Classification Search

CPC .. H01Q 1/22; H01Q 1/38; H01Q 9/06; H01Q 21/06

USPC ..... 343/700 MS

See application file for complete search history.

(56) References Cited

U.S. PATENT DOCUMENTS

| | | | | |
|---|---|---|---|---|
| 7,498,940 | B2 | 3/2009 | Pattus | |
| 2010/0167082 | A1* | 7/2010 | Oh | D21H 19/02 428/608 |
| 2016/0012329 | A1* | 1/2016 | Machado | G06K 19/07786 235/492 |

FOREIGN PATENT DOCUMENTS

| | | | |
|---|---|---|---|
| EP | 2 966 221 | A1 | 1/2016 |
| KR | 10-2007-0088457 | A | 8/2007 |
| KR | 10-2008-0107977 | A | 12/2008 |
| KR | 10-2016-0005848 | A | 1/2016 |

* cited by examiner

*Primary Examiner* — Andrea Lindgren Baltzell

(74) *Attorney, Agent, or Firm* — LRK Patent Law Firm

(57) ABSTRACT

Security paper based on an RF tag using a dipole array structure and a method for manufacturing the security paper. The security paper based on an RF tag using a dipole array structure includes first base paper, second base paper, and an RF tag printed on at least one of the first base paper and the second base paper, wherein the RF tag is configured such that multiple dipole antennas form an array structure. Also, the security paper based on an RF tag using a dipole array structure may include a layer configured with a pattern or a color or a carbon-coated layer, whereby the location of the RE tag is prevented from being exposed and whether the corresponding paper is security paper may be detected.

20 Claims, 4 Drawing Sheets

SECURITY PAPER BASED ON RF TAG USING DIPOLE ARRAY STRUCTURE AND METHOD FOR MANUFACTURING THE SECURITY PAPER

CROSS REFERENCE TO RELATED APPLICATION

This application claims the benefit of Korean Patent Application No. 10-2016-0124477, filed Sep. 28, 2016, which is hereby incorporated by reference in its entirety into this application.

BACKGROUND OF THE INVENTION

1. Technical Field

The present invention relates generally to security paper based on an RF tag and a method for manufacturing the security paper and, more particularly, to security paper, the illegal leakage of which may be prevented by printing an RE tag using a dipole array structure.

2. Description of the Related Art

Conventional document security technology uses a logging method, a method using a password, an encryption information printing method, a method using copy prevention paper, and the like. In the logging method, when a document is read, printed or copied, the history thereof is recorded and managed. Accordingly, in the event of an incident in connection with the leakage of the document, it is possible to track the person who accessed the document, but it is difficult to preemptively prevent such an incident.

In the case of the method using a password, because a password granted to an authorized person is requested when a document is accessed, a security incident attributable to unauthorized access may be prevented. However, this method has a limitation in that the leakage of a document by an authorized person may not be prevented.

In the case of the encryption information printing method, when a document is copied or printed, information about the time at which the document is copied or printed, the person who copies or prints the document, and the like is printed therewith. Accordingly, in the event of an incident in connection with the leakage of a document, the route through which the document leaked may be detected, but the damage may not be restored.

Also, in the case of the method using copy prevention paper, the leakage of a document may be prevented thanks to paper that is specially processed in order to preclude the content of an original document from being copied, but documents necessary for work cannot be copied either, thus causing inconvenience. Further, this method may not prevent an original document from being leaked.

In order to solve these problems, security paper, which may prevent a document from being leaked and may be easily used when printing, copying, or faxing a document, has been developed. Here, "security paper" means paper that is processed using a special technique invented in order to prevent the modification, falsification, and the like of an original document, as well as to prevent a document in the form of paper from being carried outside.

Particularly, electro-sensitive paper, which is one type of security paper, is paper in which material that can be sensed by a sensor is embedded. Because soft magnetic material generates a signal at a specific frequency in an AC magnetic field, electro-sensitive paper containing the soft magnetic material may be detected using a sensor that is capable of sensing a signal at the specific frequency.

However, electro-sensitive paper according to a conventional art is difficult to widely implement in practice because high expense is required in order to construct a sensing gate and because the location at which soft magnetic material is embedded in the paper may be apparent due to the thickness of the material (above the 15 micrometers).

Therefore, required are the development of technology for constructing a sensing gate at low cost and the development of security paper for reducing the risk of exposure of the location at which the soft magnetic material is embedded in the paper.

DOCUMENTS OF RELATED ART (Patent Document 1) Korean Patent Application No. 10-2014-0084605, disclosed on Jan. 18, 2016 and titled "Security paper based on chipless RE tag for preventing leakage of document and method for manufacturing the security paper".

SUMMARY OF THE INVENTION

An object of the present invention is to detect the illegal leakage of security paper containing sensitive information or the like.

Another object of the present invention is to provide security paper that has a competitive price and is more easily sensed at a security gate.

A further object of the present invention is to provide security paper using an ultrathin film structure in order to solve the problem in which the location at which an RF tag is embedded in the security paper is easily detected, whereby the RF tag is prevented from being deliberately damaged and the security paper is prevented from being leaked.

Yet another object of the present invention is to provide security paper processed in such a way that an RF tag is printed on a surface between two sheets of base paper and is then processed in order to prevent the exposure of the location of the RF tag, whereby the tag is prevented from being deliberately damaged.

Still another object of the present invention is to prevent an RF tag from being exposed at the surface of paper, whereby the paper may avoid damaging a printing device, such as a printer or the like, when a document is printed on the paper using the printing device.

In order to accomplish the above object, security paper based on an RF tag using a dipole array structure according to the present invention includes first base paper, second base paper, and an RF tag printed on at least one of the first base paper and the second base paper, wherein the RF tag is configured such that multiple dipole antennas form an array structure.

Here, the RF tag may include one or more dipole antenna blocks, which include the multiple dipole antennas, and multiple dipole antennas included in each of the dipole antenna blocks may be arranged in an identical direction.

Here, a first dipole antenna block may include a plurality of first dipole antennas, a second dipole antenna block may include a plurality of second dipole antennas, and the first dipole antennas may be arranged in a direction that differs from a direction in which the second dipole antennas are arranged.

Here, an operating frequency of the first dipole antennas may differ from an operating frequency of the second dipole antennas.

Here, spacing between the dipole antennas may be set based on at least one of an operating frequency of the dipole antennas and a length of each of the dipole antennas.

Here, the dipole antennas may be printed in conductive ink.

Here, a layer for preventing a location of the RF tag from being exposed and for enabling sensing whether paper is security paper may be formed on at least one of the first base paper and the second base paper.

Here, the layer may be formed on at least one of an internal surface of the first base paper, an external surface of the first base paper, an internal surface of the second base paper, and an external surface of the second base paper.

Here, the layer may be formed in at least one of a pattern and a color corresponding to the RF tag or by carbon-coating a corresponding surface.

Here, the layer may be formed so as to correspond to at least one of a shape, a length and a color of the dipole antennas, and spacing between the dipole antennas.

Also, a method for manufacturing security paper based on an RF tag using a dipole array structure according to an embodiment of the present invention includes preparing first base paper and second base paper, printing an RF tag, configured such that multiple dipole antennas form an array structure, on at least one of the first base paper and the second base paper, and laminating the first base paper and the second base paper by bonding the first base paper and the second base paper.

Here, printing the RF tag may be configured to print one or more dipole antenna blocks including the multiple dipole antennas, and the multiple dipole antennas included in each of the dipole antenna blocks may be arranged in an identical direction.

Here, a first dipole antenna block may include a plurality of first dipole antennas, a second dipole antenna block may include a plurality of second dipole antennas, and printing the RF tag may be configured to print the RF tag in which the first dipole antennas are arranged in a direction that differs from a direction in which the second dipole antennas are arranged.

Here, an operating frequency of the first dipole antennas may differ from an operating frequency of the second dipole antennas.

Here, printing the RF tag may be configured to print the dipole antennas so as to correspond to spacing between the dipole antennas, which is set based on at least one of an operating frequency of the dipole antennas and a length of each of the dipole antennas.

Here, printing the RF tag may be configured to print the dipole antennas in conductive ink.

Here, the method may further include forming a layer, for preventing a location of the RF tag from being exposed and for enabling sensing whether paper is security paper, on at least one of the first base paper and the second base paper.

Here, forming the layer may be configured to form the layer on at least one of an internal surface of the first base paper, an external surface of the first base paper, an internal surface of the second base paper, and an external surface of the second base paper.

Here, forming the layer may be configured to form the layer in at least one of a pattern and a color corresponding to the RF tag or by carbon-coating a corresponding surface.

Here, forming the layer may be configured to form the layer so as to correspond to at least one of a shape, a length and a color of the dipole antennas, and spacing between the dipole antennas.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
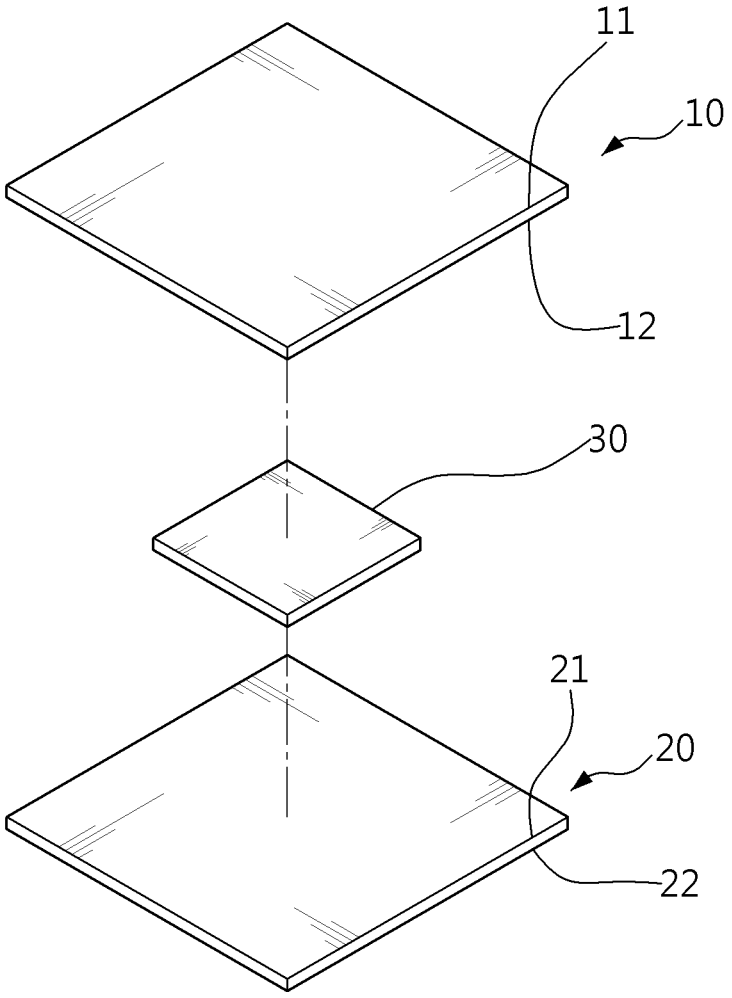
FIG. 1 is a perspective view that shows disaggregate security paper based on an RF tag using a dipole array structure according to an embodiment of the present invention.

The present invention may be variously changed, and may have various embodiments, and specific embodiments will be described in detail below with reference to the attached drawings.

However, it should be understood that those embodiments are not intended to limit the present invention to specific disclosure forms and they include all changes, equivalents or modifications included in the spirit and scope of the present invention.

The terms used in the present specification are merely used to describe specific embodiments and are not intended to limit the present invention. A singular expression includes a plural expression unless a description to the contrary is specifically pointed out in context. In the present specification, it should be understood that terms such as "include" or "have" are merely intended to indicate that features, numbers, steps, operations, components, parts, or combinations thereof are present, and are not intended to exclude the possibility that one or more other features, numbers, steps, operations, components, parts, or combinations thereof will be present or added.

Unless defined differently, all terms used here including technical or scientific terms have the same meanings as terms generally understood by those skilled in the art to which the present invention pertains. The terms identical to those defined in generally used dictionaries should be interpreted as having meanings identical to contextual meanings of the related art, and are not to be interpreted as having ideal or excessively formal meanings unless they are definitely defined in the present specification.

Embodiments of the present invention will be described in detail with reference to the accompanying drawings. In the following description of the present invention, the same reference numerals are used to designate the same or similar elements throughout the drawings, and repeated descriptions of the same components will be omitted.

FIG. 1 is a perspective view that shows disaggregate security paper based on an RF tag using a dipole array structure according to an embodiment of the present invention.

As illustrated in FIG. 1, security paper based on an RF tag using a dipole array structure includes first base paper 10, second base paper 20, and an RF tag 30 using a dipole array structure.

Hereinafter, the RF tag 30 using a dipole array structure will be referred to simply as an RE tag 30 for accurate and concise description.

The first base paper 10 and the second base paper 20 may have the same composition as general printing paper. Also, an RF tag 30, which operates at one or more operating frequencies, is present between the first base paper 10 and the second base paper 20.

Also, a layer may be formed on at least one of the external surface 11 of the first base paper 10, the internal surface 12 of the first base paper 10, the internal surface 21 of the second base paper 20, and the external surface 22 of the second base paper 20.

The layer may be formed in order to prevent the location of the RF tag 30 from being exposed and to enable sensing or detecting that the corresponding paper is security paper.

Here, the layer may be formed in a pattern or color corresponding to the RF tag 30, or may be formed by being carbon-coated. Also, the layer may be formed so as to correspond to at least one of the shape, length, and color of dipole antennas included in the RF tag 30, and spacing between the dipole antennas.

Next, the RF tag 30 is configured such that multiple dipole antennas form an array structure. The RE tag 30 may be produced by being printed in conductive ink on the base paper. Here, the RF tag 30 may be printed on the surface to which the first base paper 10 or the second base paper 20 is bonded. That is, the RF tag 30 may be printed on any one of the internal surface 12 of the first base paper 10 and the internal surface 21 of the second base paper 20.

Also, the RE tag 30 may include one or more dipole antenna blocks, and each of the dipole antenna blocks may include multiple dipole antennas. Here, the RE tag 30 may include an ID value through which it may be determined whether to permit removal of security paper including the corresponding RF tag 30.

As illustrated in FIG. 1, a single sheet of security paper may be formed such that the RF tag 30 is present between a single sheet of first base paper 10 and a single sheet of second base paper 20.

Here, desirably, the number of dipole antennas included in the RF tag 30, the length of each of the dipole antennas, and spacing between the dipole antennas may be set to the optimal number, length and spacing in order to improve the rate at which the RF tag 30 is sensed and to lower production costs.

The length of each of the dipole antennas may be set depending on the frequency that is used, and may be selected according to the purpose of the use intended by a user or based on a security gate (an RF tag reader). Also, the spacing between dipole antennas may be set depending on the operating frequency of the dipole antennas and the length of each of the dipole antennas, and half-wavelength dipole antennas may be arranged.

Hereinafter, an RF tag using a dipole array structure according to an embodiment of the present invention will be described in detail with reference to FIG. 2 and FIG. 3.

Figure 2:
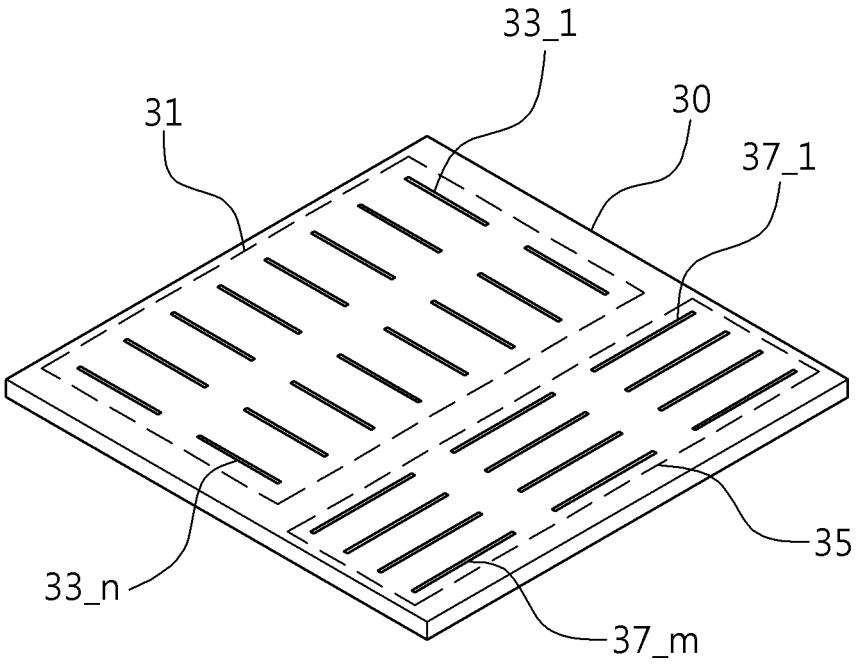
FIG. 2 is a view that shows an RF tag using a dipole array structure according to an embodiment of the present invention.

FIG. 2 is a view that shows an RF tag using a dipole array structure according to an embodiment of the present invention.

As illustrated in FIG. 2, the RF tag 30 may include one or more dipole antenna blocks 31 and 35. Also, each of the dipole antenna blocks 31 and 35 may include multiple dipole antennas 33_1 to **33_*n* or 37_1 to 37_*m***.

Here, dipole antennas included in the same dipole antenna block may form an array by being arranged in the same direction, but dipole antennas included in different dipole antenna blocks may be arranged in different directions.

As illustrated in FIG. 2, one of the first dipole antennas 33_1 and another one of the first dipole antennas **33_*n*, included in the first dipole antenna block 31, may have the same length, the same shape, and the same operating frequency, and they may be arranged in the same direction. Also, one of the second dipole antennas 37_1 and another one of the second dipole antennas 37_*m*, included in the second dipole antenna block 35**, may have the same length, the same shape, and the same operating frequency, and they may be arranged in the same direction.

Also, the direction in which the first dipole antennas 33_1 to **33_*n*, included in the first dipole antenna block 31, are arranged may differ from the direction in which the second dipole antennas 37_1 to 37_*m*, included in the second dipole antenna block 35, are arranged. Also, the length and operating frequency of the first dipole antennas 33_1 to 33_*n* may differ from those of the second dipole antennas 37_1 to 37_*m*. In particular, the direction in which the first dipole antennas 33_1 to 33_*n* are arranged may be perpendicular to the direction in which the second dipole antennas 37_1 to 37_*m*** are arranged.

For the convenience of description, the RF tag 30 has been described as including two dipole antenna blocks, but without limitation thereto, the RF tag 30 may include a single dipole antenna block, or may include three or more dipole antenna blocks.

Figure 3:
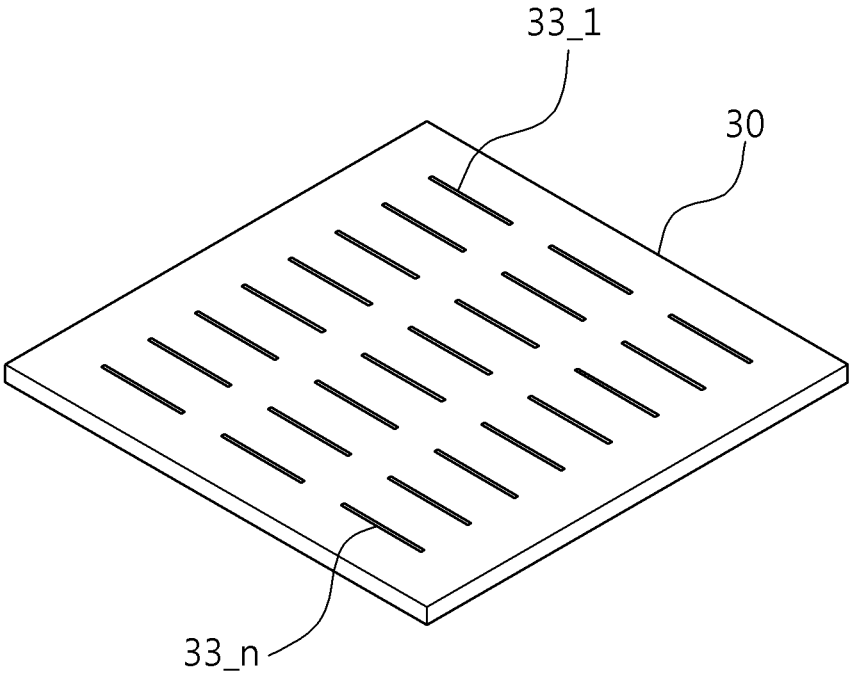
FIG. 3 is a view that shows an RF tag including a single dipole antenna block according to an embodiment of the present invention.

When the RF tag 30 includes a single dipole antenna block, the RF tag 30 may appear as shown in FIG. 3.

FIG. 3 is a view that shows an RF tag including a single dipole antenna block according to an embodiment of the present invention.

As illustrated in FIG. 3, the RF tag 30 may be configured with multiple dipole antennas 33, and the multiple dipole antennas 33 included in the RF tag 30 may have the same length and the same operating frequency, and may be arranged in the same direction.

For the convenience of description, the RF tag 30 has been described as including a single dipole antenna block, but this indicates that all of the dipole antennas included in the RF tag 30 have the same length and the same operating frequency and are arranged in the same direction. That is, the RF tag 30 may be configured to include such multiple dipole antennas without a dipole antenna block.

Hereinafter, the structure of the section of security paper based on an RF tag using a dipole array structure according to an embodiment of the present invention will be described with reference to FIG. 4 and FIG. 5.

Figure 4:
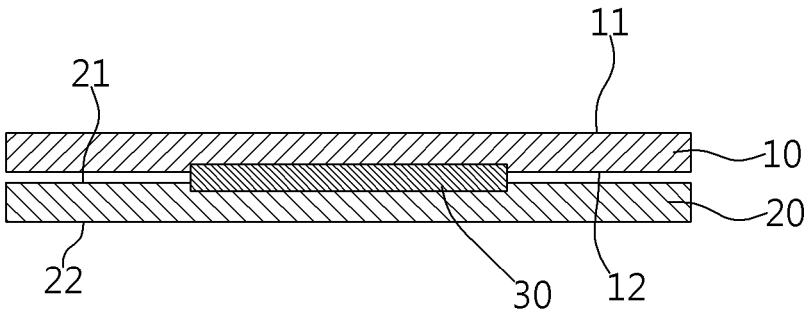
FIG. 4 is a sectional view of security paper based on an RF tag using a dipole array structure according to an embodiment of the present invention.

FIG. 4 is a sectional view of security paper based on an RF tag using a dipole array structure according to an embodiment of the present invention.

As illustrated in FIG. 4, the RF tag 30 is printed on at least one of the internal surface 12 of the first base paper 10 and the internal surface 21 of the second base paper 20, Here, the RF tag 30 may be printed using conductive ink.

After the RF tag 30 is printed on at least one of the internal surface 12 of the first base paper 10 and the internal surface 21 of the second base paper 20, the internal surface 12 of the first base paper 10 and the internal surface 21 of the second base paper 20 are bonded together using an adhesive.

In FIG. 4, although a gap is shown between the first base paper 10 and the second base paper 20, this is merely intended to explain the internal and external surfaces of the first base paper 10 and the second base paper 20. Actually, because the first base paper 10 and the second base paper 20 are bonded together using an adhesive, such as glue or the like, there is no gap therebetween.

Figure 5:
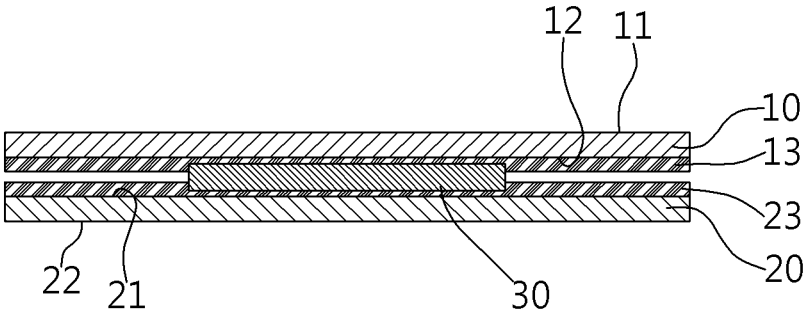
FIG. 5 is a sectional view that shows an example in which a layer is formed in security paper based on an RF tag using a dipole array structure according to an embodiment of the present invention.

FIG. 5 is a sectional view that shows an example in which a layer is formed in security paper based on an RF tag using a dipole array structure according to an embodiment of the present invention.

In the case of security paper based on an RF tag using a dipole array structure, the location of the RF tag in the security paper may be exposed by shining light on the security paper. When the location of the RE tag 30 is exposed, the RF tag 30 may be deliberately damaged, whereby the corresponding security paper may not be sensed at a security gate.

In order to solve this problem, a layer may be formed in security paper based on an RF tag using a dipole array structure according to an embodiment of the present invention. The layer may be formed in order to prevent the location of the RF tag 30 from being exposed and to enable sensing that the corresponding paper is security paper.

As illustrated in FIG. 5, a layer 13 may be formed on the internal surface 12 of the first base paper 10 and the internal surface 21 of the second base paper 20. For the convenience of description, the layer 13 has been described as being formed on the internal surface 12 of the first base paper 12 and the internal surface 21 of the second base paper 20, but without limitation thereto, layers 13 and 23 may be formed on at least one of the external surface 11 of the first base paper 10, the internal surface 12 of the first base paper 10, the internal surface 21 of the second base paper 20 and the external surface 22 of the second base paper 20.

Here, the layer 13 formed on at least one of the surfaces 11, 12, 21 and 22 of the base paper 10 and 20 may be formed by carbon-coating one of the surfaces 11, 12, 21 and 22 of the base paper or by applying a specific pattern or a specific color to one of the surfaces 11, 12, 21 and 22.

Although FIG. 5 shows an example in which a first layer 13 and a second layer 23 are formed on the internal surface 12 of the first base paper 10 and the internal surface 21 of the second base paper 20, respectively, this is not limiting, and the first layer 13 may be formed on at least one of the external surface 11 and the internal surface 12 of the first base paper 10, and the second layer 23 may be formed on at least one of the internal surface 21 and the external surface 22 of the second base paper 20.

At least one of the specific pattern and the specific color, applied to form the layer 13 or 23, may correspond to the RF tag 30. For example, when the RF tag 30 is printed in opaque silver or gray color ink, the layer 13 or 23 may be formed in a color corresponding thereto or a color that is darker than that. Also, the layer 13 or 23 may be formed in a pattern corresponding to at least one of the shape and length of dipole antennas included in the RF tag 30 and spacing between the dipole antennas.

As described above, the security paper based on an RF tag using a dipole array structure may form a carbon-coated layer or a layer configured with a specific pattern or a specific color, and may thereby prevent the location of the RF tag 30 from being exposed. Also, the layer may be used as an indicator for enabling a sensing unit, such as a security gate or the like, to sense that the corresponding paper is security paper.

Also, although a gap is depicted between the first base paper 10 and the second base paper 20 in FIG. 5, this is merely intended to explain the internal and external surfaces of the first base paper 10 and the second base paper 20. Actually, there is no gap between the first base paper 10 and the second base paper 20, because they are bonded together using an adhesive such as glue or the like.

Hereinafter, a method for manufacturing security paper based on an RE tag using a dipole array structure according to an embodiment of the present invention will be described in detail with reference FIG. 6.

Figure 6:
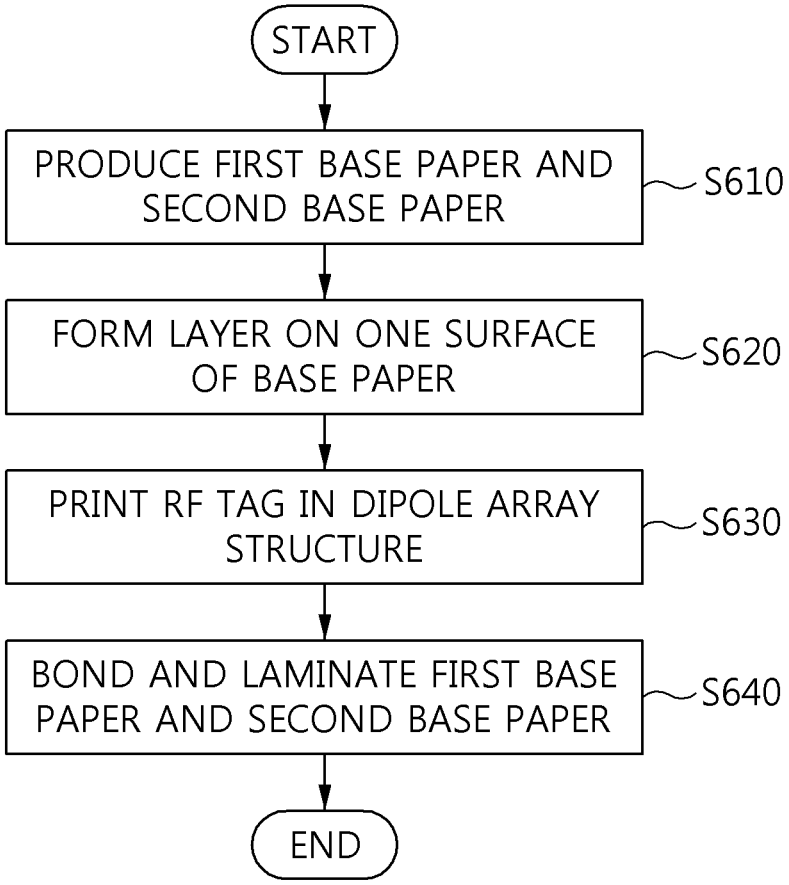
FIG. 6 is a flowchart of a method for manufacturing security paper based on an RF tag using a dipole array structure according to an embodiment of the present invention.

FIG. 6 is a flowchart describing a method for manufacturing security paper based on an RF tag using a dipole array structure according to an embodiment of the present invention.

The description to be made below may be understood as a description of the operations performed by an apparatus for manufacturing security paper.

First, first base paper 10 and second base paper 20 are manufactured at step S610.

Of course, it is possible to prepare previously manufactured first base paper 10 and second base paper 20. Here, because the method for manufacturing the first base paper 10 and the second base paper 20 are sufficiently understood by those skilled in the art, a description thereof will be omitted.

Then, a layer is formed on one surface of the base paper 10 and 20 at step S620.

Here, the layer may be formed on one surface of the first base paper 10 and the second base paper 20 in order to prevent the exposure of the location of an RF tag 30 using a dipole array structure, which is to be included in security paper at step S630, which will be described later, and in order to enable sensing whether the corresponding paper is security paper.

Here, the layer may be formed (or printed) on at least one of the internal and external surfaces of the first base paper 10 and the internal and external surfaces of the second base paper 20. Also, the layer may be formed by applying a specific pattern or a specific color to the selected surface, or by carbon-coating the selected surface. Here, the specific pattern may be a pattern corresponding to dipole antennas included in the RF tag 30 using a dipole array structure or a pattern that differs therefrom. Also, the specific color may be similar to the color of the dipole antennas, or may be darker than that. However, the pattern or color of the layer is not limited to these examples.

Because the opacity of the security paper based on an RF tag using a dipole array structure is increased through the above process, the location of the RF tag 30 may not be detected when shining light on the security paper, whereby the RF tag may be prevented from being deliberately damaged.

Then, an RF tag using a dipole array structure is printed at step S630.

The RF tag 30 using a dipole array structure is printed on any one of the first base paper 10 and the second base paper 20. Specifically, the RF tag 30 using a dipole array structure may be printed on the internal surface of the first base paper 10 or the internal surface of the second base paper 20.

For the convenience of manufacture, the RF tag 30 using a dipole array structure has been described as being printed after forming a layer on at least one surface of the first base paper 10 and the second base paper 20, but this is not limiting, and the RF tag 30 using a dipole array structure may be printed before forming a layer on one surface of the first base paper 10 and the second base paper 20 according to need.

Finally, the first base paper 10 and the second base paper 20 are bonded and laminated at step S640.

The first base paper 10 and the second base paper 20 may be bonded together using an adhesive, such as glue or the like, and one sheet of security paper based on an RF tag using a dipole array structure may be produced through the bonding and lamination of the first base paper 10 and the second base paper 20.

According to the present invention, it is possible to detect the illegal leakage of security paper containing sensitive information or the like.

Also, according to the present invention, it is possible to provide security paper that has a competitive price and is more easily sensed at a security gate.

Also, according to the present invention, because an ultrathin film structure is used, the problem in which the location at which an RF tag is embedded in the security paper is easily detected may be solved, whereby the RF tag may be prevented from being deliberately damaged and the security paper may be prevented from being leaked.

Also, according to the present invention, because an RF tag is printed on a surface between two sheets of base paper and is then processed in order to prevent the exposure of the location of the RF tag, the tag may be prevented from being deliberately damaged.

Also, according to the present invention, because an RF tag is prevented from being exposed at the surface of paper, the paper may avoid damaging a printing device, such as a printer or the like, when a document is printed on the paper using the printing device.

As described above, security paper based on an RF tag using a dipole array structure and a method for manufacturing the security paper according to the present invention are not limitedly applied to the configurations and operations of the above-described embodiments, but all or some of the embodiments may be selectively combined and configured, so that the embodiments may be modified in various ways.

What is claimed is:

1. Security paper based on an RF tag using a dipole array structure, comprising:

first base paper;

second base paper; and an RF tag printed on at least one of an internal surface of the first base paper and an internal surface of the second base paper, the internal surface of the first base paper and the internal surface of the second base paper facing each other and being bonded together using an adhesive, wherein the RF tag is configured such that multiple dipole antennas form an array structure.

2. The security paper of claim 1, wherein:

the RF tag includes one or more dipole antenna blocks, which include the multiple dipole antennas; and multiple dipole antennas included in each of the dipole antenna blocks are arranged in an identical direction.

3. The security paper of claim 2, wherein:

a first dipole antenna block includes a plurality of first dipole antennas;

a second dipole antenna block includes a plurality of second dipole antennas; and the first dipole antennas are arranged in a direction that differs from a direction in which the second dipole antennas are arranged.

4. The security paper of claim 3, wherein an operating frequency of the first dipole antennas differs from an operating frequency of the second dipole antennas.

5. The security paper of claim 1, wherein spacing between the dipole antennas is set based on at least one of an operating frequency of the dipole antennas and a length of each of the dipole antennas.

6. The security paper of claim 1, wherein the dipole antennas are printed in conductive ink.

7. The security paper of claim 1, further comprising a layer formed on at least one of the first base paper and the second base paper so as to prevent a location of the RF tag from being exposed and to enable sensing the security paper.

8. The security paper of claim 7, wherein the layer is formed on at least one of the internal surface of the first base paper, an external surface of the first base paper, the internal surface of the second base paper, and an external surface of the second base paper.

9. The security paper of claim 8, wherein the layer is formed in at least one of a pattern and a color corresponding to the RF tag or by carbon-coating a corresponding surface.

10. The security paper of claim 9, wherein the layer is formed so as to correspond to at least one of a shape, a length and a color of the dipole antennas, and spacing between the dipole antennas.

11. A method for manufacturing security paper based on an RF tag using a dipole array structure, the method comprising:

preparing first base paper and second base paper;

printing an RF tag, configured such that multiple dipole antennas form an array structure, on at least one of an internal surface of the first base paper and an internal surface of the second base paper; and laminating the first base paper and the second base paper by bonding the internal surface of the first base paper and the internal surface of the second base paper together using an adhesive.

12. The method of claim 11, wherein:

the printing the RF tag is configured to print one or more dipole antenna blocks including the multiple dipole antennas; and the multiple dipole antennas included in each of the dipole antenna blocks are arranged in an identical direction.

13. The method of claim 12, wherein:

a first dipole antenna block includes a plurality of first dipole antennas;

a second dipole antenna block includes a plurality of second dipole antennas; and the printing the RF tag is configured to print the RF tag in which the first dipole antennas are arranged in a direction that differs from a direction in which the second dipole antennas are arranged.

14. The method of claim 13, wherein an operating frequency of the first dipole antennas differs from an operating frequency of the second dipole antennas.

15. The method of claim 11, wherein the printing the RF tag is configured to print the dipole antennas so as to correspond to spacing between the dipole antennas, which is set based on at least one of an operating frequency of the dipole antennas and a length of each of the dipole antennas.

16. The method of claim 11, wherein the printing the RF tag is configured to print the dipole antennas in conductive ink.

17. The method of claim 11, further comprising:

forming a layer on at least one of the first base paper and the second base paper so as to prevent a location of the RF tag from being exposed and to enable sensing the security paper.

18. The method of claim 17, wherein the forming the layer is configured to form the layer on at least one of the internal surface of the first base paper, an external surface of the first base paper, the internal surface of the second base paper, and an external surface of the second base paper.

19. The method of claim 18, wherein the forming the layer is configured to form the layer in at least one of a pattern and a color corresponding to the RF tag or by carbon-coating a corresponding surface.

20. The method of claim 19, wherein the forming the layer is configured to form the layer so as to correspond to at least one of a shape, a length and a color of the dipole antennas, and spacing between the dipole antennas.

* * * * *